US005238204A

United States Patent [19]

Metz

[11] Patent Number: 5,238,204

[45] Date of Patent: Aug. 24, 1993

[54] GUIDED PROJECTILE

[75] Inventor: Pierre Metz, Paris, France

[73] Assignee: Thomson-CSF, Paris, France

[21] Appl. No.: 928,976

[22] Filed: Jul. 28, 1978

[51] Int. Cl.[5] ..... F41G 7/00; F42B 10/60; F42B 15/01

[52] U.S. Cl. ..... 244/3.15; 244/3.22

[58] Field of Search ..... 244/3.22, 3.15, 3.1; 102/61

[56] References Cited

U.S. PATENT DOCUMENTS

| | | | |
|---|---|---|---|
| 3,282,541 | 11/1966 | Webb | 244/3.22 |
| 3,304,029 | 2/1967 | Ludtke | 244/3.22 X |
| 3,374,967 | 3/1968 | Plumley | 244/3.22 X |
| 3,645,475 | 2/1972 | Stripling | 244/3.22 |
| 3,749,334 | 7/1973 | McCorkle | 244/3.22 |

*Primary Examiner*—David H. Brown

*Attorney, Agent, or Firm*—Herbert Dubno

[57] ABSTRACT

A guided projectile, especially a propelled or ballistic missile, has its trajectory corrected by gas jets from pulse thrusters disposed in at least on axial plane of the missile symmetrically on opposite sides of the center of gravity thereof and whose thrusts are countered, when no longer needed, by the operation of diametrically opposite pulse thrusters in the same plane and at the same side of the center of gravity. The pulse thrusters are formed as gas generators which can be triggered to feed respective nozzles. The projectile is also roll stabilized, e.g. by a rotatable empennage. The transverse thrusts produced by the pulse thrusters are controlled by a sensor which responds to deviations from the correct orientation of the missile. The invention is particularly applicable to self-guided or homing tactical weapons.

16 Claims, 9 Drawing Sheets

GUIDED PROJECTILE

FIELD OF THE INVENTION

The present invention relates to guided projectiles and, more particularly, to a projectile system in which transverse thrust is imparted to the missile to adjust the flight path thereof. More particularly, the invention relates to a guided projectile in which gas jets are used to provide a thrust which is transverse with respect to the longitudinal axis and has a force resultant which can be considered as applied to the center of gravity of the projectile.

BACKGROUND OF THE INVENTION

Guided projectiles in which the direction of flight is controlled by the use of transverse gas jets operated in a pulselike manner are known. Such systems can be applicable to rockets and, in general, to all types of guided projectiles. The term "guided projectile" as used herein to discuss the prior art and the system of the present invention should be understood to be applicable to all types of propelled or ballistic missiles, e.g. rockets, bombs and the like. For the purposes the present invention, however, it will be understood to be particularly directed at self-propelled short range tactical missiles.

The range of a projectile fired at a fixed or moving target is limited by various factors and, particularly, the aiming precision and dispersion at the launching site, deviations of the trajectory under the effect of atmospheric disturbances, aerodynamic imperfections in construction of the projectile and, possibly, movement of the target during the flight time of the projectile.

Because of all of these error-introducing elements, it is necessary to correct the projectile trajectory in flight to be sure that it will hit the target or come sufficiently close to perform its destructive purpose.

These trajectory corrections can be carried out over the whole flight path or only over some large or small part of it, e.g. the final phase of the flight.

To modify the projectile trajectory and, more precisely, to correct deviations from the desired trajectory, means can be provided for measuring the deviation and for generating an error signal which can operate means for applying forces to the projectile having a trajectory-correcting effect.

Detection of trajectory deviations can be performed from a sighting point which generates the correction instructions which can be transmitted by remote control to the trajectory-correcting or flight-path-correcting units on board the projectile. Alternatively, the projectile may be provided with a homing head which itself responds to deviations of the flight path from the desired trajectory to the target and produces the error signals which bring about correction of the trajectory.

Various techniques are used to modify the movement of the projectile in the aforementioned corrective manner. For example, it has been proposed to modify the flight attitude of the missile by varying its incident angle or attack angle. The resulting aerodynamic force is approximately proportional to the incident angle. The incident angle can be varied by modifying the aerodynamic-rudder positions, by the ejection of lateral gas jets, by changing the orientation of the rocket-motor gas jet or by other procedures accomplishing the same purpose.

In another approach, of a more limited utility, the movement of the missile is modified by applying to the center of gravity of the rocket a force or thrust which is transverse to its longitudinal axis and thus directly shifts the center of gravity without having to control the attitude of the projectile, i.e. the position of its axis vis-á-vis the center of gravity.

To produce such transverse forces, it has been suggested that the projectile be fitted with pyrotechnic devices capable of supplying thrusts in pulses by the ejection of gases from nozzles. This guidance method has the advantage that it applies a force to the center of gravity of the missile with a fast response to the error signal and enables the guidance of a missile without any adjustable aerodynamic control surface.

However, this system has been found to experience difficulties in that prior-art pyrotechnic devices and, in general, transverse-thrust-generating systems, which can be easily controlled and can permit trajectory correction to be made without overcorrection or complex control equipment.

OBJECTS OF THE INVENTION

It is the principal object of the present invention to provide a control system for a guided projectile, especially a military rocket, missile, bomb or the like of the propelled or ballistic type which is free from the disadvantages of earlier systems and, in a highly precise and readily controllable manner, enables a transverse thrust to be applied to the missile or projectile.

Another object of the invention is to provide improved means, in a missile of the aforedescribed type, for producing transverse thrusts whose amplitude and direction can be readily controlled.

It is yet another object of the invention to provide an improved guidance system for a missile which is free from moving mechanical parts capable of failure.

Still another object of the invention is to provide improved guidance means for a projectile of the type which can be fired from a launching tube.

SUMMARY OF THE INVENTION

These objects and others which will become apparent hereinafter are attained, in accordance with the present invention, by providing a guided projectile having a center of gravity located along its axis and of an elongated configuration with pulse thrusters symmetrically disposed, in a common axial plane and on a common side of the missile, to opposite sides of the center of gravity, the pulse thrusters being formed with a triggerable gas generator feeding one or more thrust-generating nozzles. Thus the pulse thrusters are disposed symmetrically on one side and the other of the center of gravity along a common side of the rocket and in the same axial plane, being interconnected in pairs so that the thrust they deliver may be applied to the center of gravity of the projectile without tipping the latter, i.e. changing the attitude of the axis about the center of gravity.

A pulse thruster according to the invention includes a gas generator which is formed by a combustion chamber, preferably of annular configuration within the missile surrounding a warhead or equipment compartment, the combustion chamber receiving a block of a solid pyrotechnic material or propellant such as solid propergol, and an explosive device or squib to trigger combustion of the propergol. This combustion chamber is coupled to a pair of thrust nozzles which are diametrically opposite one another and are spaced along a transverse axis of the missile to direct gas jets in diametrically opposite directions. Each of the pairs of diametrically opposite nozzles is provided with obturating means which can be released in response to a control signal for fully opening the respective thrust nozzle. In the absence of this signal, however, the obturating means or closure completely blocks the nozzle output. This is intended to provide all-or-nothing control of the pulse thruster.

According to a preferred embodiment of the invention, the pulse thrusters are connected in pairs so that the triggering of two gas generators at the same time and the simultaneous or collateral opening of two nozzles turned in a given direction produces transverse thrusts or forces whose resultant is applied to the center of gravity of the projectile. If, when the corrective thrust is no longer desired, the two diametrically opposite pulse thruster nozzles are opened, the thrust resultant is nullified or canceled. As a consequence, one pair of pulse thrusters on one side of the missile deliver a transverse thrust as a burst in the diametrically opposite direction, the action on the projectile being proportional to the algebraic sum of the individual thrusts and to the time between the opening of the nozzles turned in a given direction and the instant when those turned in the diametrically opposite direction are opened.

The pulse thrusters or, more precisely, the direction of the couples of the nozzles, is turned along the guidance director planes, usually two orthogonal director planes. For each of these planes, the pairs of pulse-thrusting nozzles are activated in sequence by timing means, which can be of compact electronic or integrated-circuit design, in order to modify the movement of the projectile at different points of the trajectory to correct successively the deviations which may appear throughout this trajectory.

In order to roll-stabilize the projectile, means is provided to stabilize the orientation of the guidance director planes. The roll-stabilizing means may be a rotatable empennage attached to the fusilage of the missile and rotatable so that the fins of this empennage assume different angular positions in accordance with the tendency of the body of the projectile to deviate from its original roll orientation.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
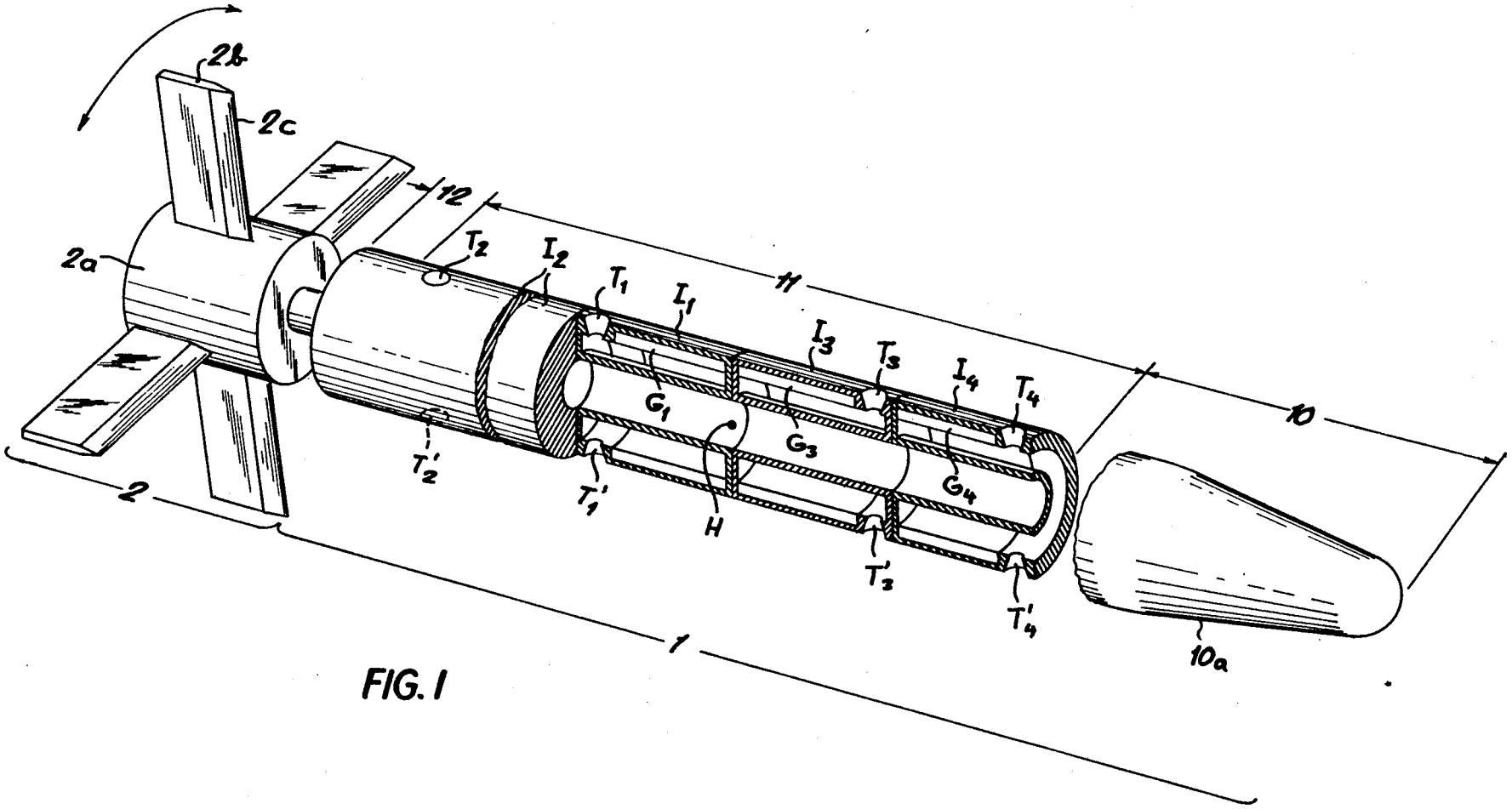
FIG. 1 is a partial sectional view of a projectile embodying the invention, the various elements of the projectile being shown in highly diagrammatic form.

FIG. 1 illustrates a guided missile in accordance with the present invention in which various elements have been omitted in order to show essential features thereof. The omitted structural elements have been fully illustrated in the subsequent FIGURES, especially FIGS. 8*a*–8*d* and hence will be described more fully below. However, control elements, warheads, the electronic circuitry and other systems commonly present in a self-propelled tactical rocket have not been illustrated and, indeed, to the extent these systems are not described below, the projectile of the present invention may use any of them known in the art.

Reference has been made heretofore to guidance director planes and some clarification thereof may be in order. For the purpose of the present invention, a guidance director plane is the plane of the axis of the projectile along the flight path thereof. The principal guidance director planes are the elevation plane, i.e. the axial plane of the projectile which coincides with the vertical plane through the line of flight. The bearing plane is the axial plane of the projectile which is orthogonal or perpendicular to the elevation plane.

The pulse thrusters have been shown, at least in FIG. 1, only in their orientation along the guidance director plane which is the elevation plane. However, in practice, a corresponding number of pulse-thruster nozzles will be understood to lie in the orthogonal plane thereto, namely, the bearing plane. Thus, in general, the invention provides means for correcting the trajectory in a plurality of guidance director planes.

The projectile shown in FIG. 1 is, as noted, of the self-propelled or ballistic type and comprises two main parts, namely, a body generally represented at 1 and an empennage 2 which is rotatable relative to the body. For the sake of illustration, this empennage 2 is shown to have a hub 2*a* from which radially extending fins 2*b* project in angularly equispaced relationship, the fins converging in the direction of flight to a leading edge 2*c* and being, if desired, of aerodynamic configuration.

The missile body, in turn, comprises three principal sections, namely, the nose 10 which is formed with a conical housing. The latter can be transparent to electromagnetic waves and is represented at 10*a*. Within this housing there may be provided a homing sensor of the electro-optical or RADAR type for tracking electromagnetic radiation from the target designated and delivering electrical signals representing instantaneous deviations of the flight trajectory from the desired flight path on target. The amplitudes of the signals used to measure deviation from the desired flight trajectory may be proportional to the target angular offset or to the angle between the line of sight to the target and the existing flight path.

The central section 11 of the body contains pulse thrusters $I_1$, $I_2$, $I_3$ and $I_4$, namely, an even number of pulse thrusters which are physically fixed relative to the axis of the missile along whichlies the center of gravity H. These pulse thrusters are identical.

Each of the pulse thrusters comprises a gas generator $G_1$, $G_3$, $G_4$ (the gas generator of the thruster $I_2$ being concealed in the section shown in FIG. 1) with each gas generator being coupled to a pair of thrust nozzles $T_1$ and $T'_1$, for example. In the embodiment illustrated in FIG. 1, the gas chamber $G_3$ is shown to be provided with the thrust nozzles $T_3$ and $T'_3$ while the gas chamber $G_4$ communicates with the thrust nozzles $T_4$ and $T'_4$, respectively. The thrust nozzle $T_2$ is, of course, connected to the gas chamber of the pulse thruster $I_2$.

For each of the pulse thrusters, the nozzles, e.g. $T_1$ and $T'_1$, are disposed diametrically opposite one another and open outwardly along the guidance director plane, namely, the elevation director plane.

The pulse thrusters are disposed symmetrically on one side and on the other (along the axis of the projectile) of the center of gravity H and the number of pulse thrusters will depend on the number of trajectory corrections to be applied to the missile, it being understood that once the pulse thruster is triggered in accordance with the invention it cannot be cut off.

To supply corrections in the second guidance director plane, e.g. in the bearing plane, the pairs of pulse-thruster nozzles for the additional gas chambers or the gas chambers already described must be offset alternately by 90° for example.

The body 1 of the projectile also has a rear section 12 which contains the pulse-thruster control means. The latter receives signals whose values represent the projectile trajectory guidance errors from the homing device or other sensor in the nose cone 10. The error signals are provided as timed or timing signals to the pulse thrusters in a manner which will be described below.

The rear section 12 also includes the means for controlling the empennage 2 and hence for stabilizing the roll attitude of the projectile in accordance with a reference attitude determined by an inertial sensor which can be of conventional design and has not been illustrated in FIG. 1.

Thus, the finned empennage 2 is free to rotate about the longitudinal axis of the projectile. Under the action of the aerodynamic forces induced by the forward movement of the projectile, the fins **2*b*** supply a resistive couple which is transmitted to the rotor of a coupled transmitter providing a link between these fins and the projectile body. The various control devices and the operation thereof will be detailed below.

The arrangement of the various elements of the projectile given above has only been presented as an illustration of the principles of the invention and can be changed without modifying these principles or the main characteristics thereof. For example, the control system shown to be illustrated in the rear portion of the body can be provided in the nose cone with the homing device or the homing device may be omitted entirely and a receiver be provided in the rear of the missile for picking up control signals transmitted from a control site on the ground or at another location. Furthermore, the pulse thrusters need not all be assembled at the center on the missile but can be paired fore and aft on the center of gravity H at the opposite ends of the missile if desired. Details of the various power sources, explosive safety devices and the timing mechanisms, which are not part of the invention, will not be described and for these systems any of the devices for the purposes described known to the art may be used. However, the warhead and its links with the elements of the present invention will be more specifically described hereinafter.

Figure 2:
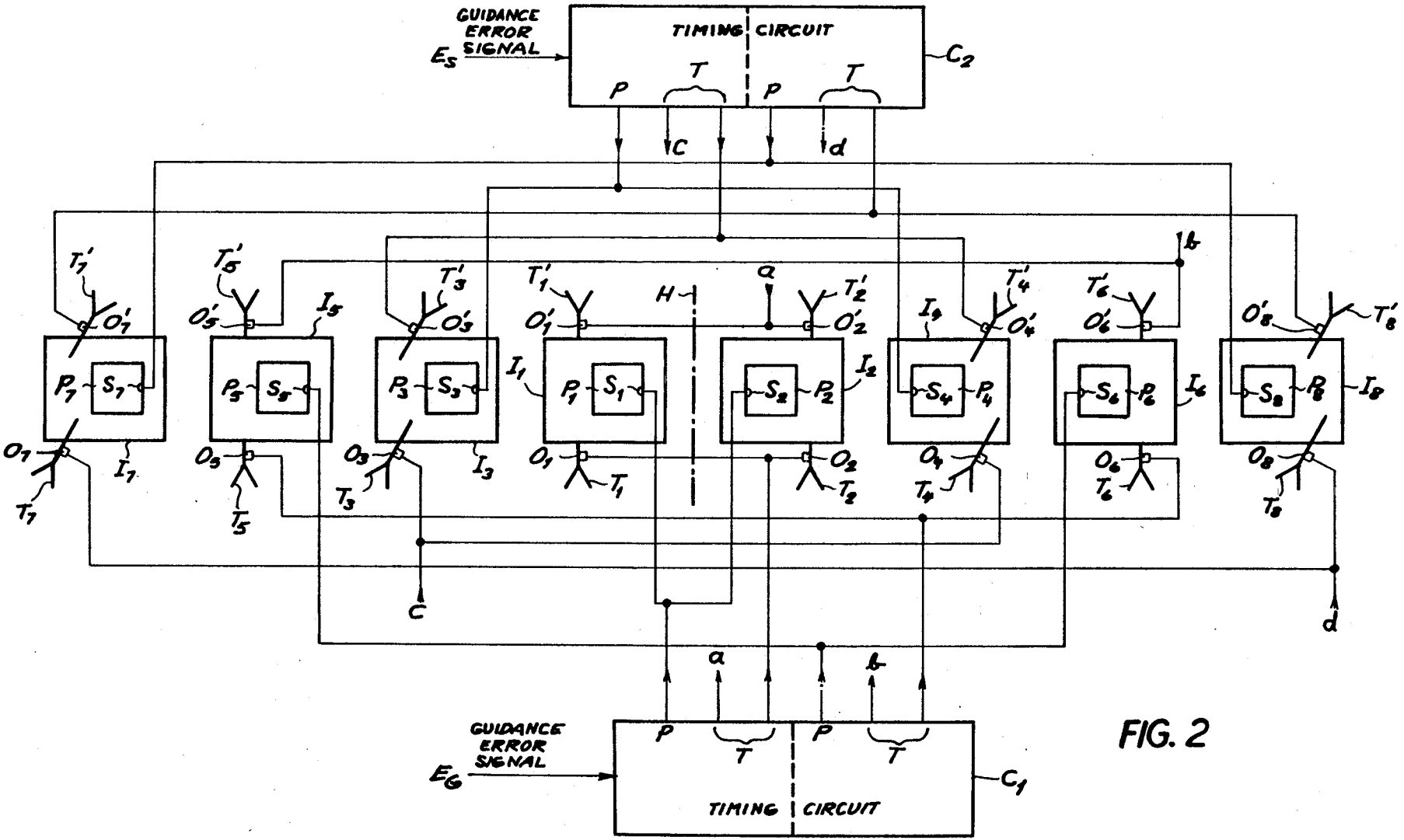
FIG. 2 is a block diagram of a circuit for energizing the multiplicity of pulse thrusters and related elements of the system of the present invention.

FIG. 2 shows the interconnections of the pulse-thruster units with the control means for converting the signals representing guidance errors into instructions for correction them.

Let us assume that the pulse thrusters are divided into two groups, namely, a group of two pairs of pulse thrusters $I_1$, $I_2$ and $I_5$, $I_6$ whose nozzles $T_1$, $T'_1$; $T_2$, $T'_2$ and $T_5$, $T'_5$; $T_6$, $T'_6$, respectively, are oriented in the bearing plane, and a group of two pairs of pulse thrusters $I_3$, $I_4$ and $I_7$, $I_8$ whose nozzles $T_3$, $T'_3$; $T_4$, $t'_4$ and $T_7$, $T'_7$; $T_8$, $T'_8$, respectively, are oriented in the elevation plane.

The terms "elevation" and "bearing" are, of course, purely arbitrary and may simply represent two main guidance planes which are preferably orthogonal (perpendicular) to one another.

The pulse-thruster combustion or burning chambers are all filled with blocks of the solid propellant propergol as represented at P with the appropriate subscript. Each of these blocks is fitted with a pyrotechnic firing device such as a squib. Each squib has been represented at S with the appropriate subscript. Thus the blocks of propergol $P_1$–$P_8$ are formed with squibs $S_1$–$S_8$, respectively. The nozzles $T_1$–$T_8$ and $T'_1$–$T'_8$ are fitted with obturating means which can be released by the action of an electrical control. For the sake of illustration, each such obturating device is representat at $O_1$–$O_8$ and $O'_1$–$O'_8$, respectively.

In each pulse-thruster group, the pulse thrusters are electrically connected in pairs on the one hand and the propergol blocks are connected in pairs on the other hand. The nozzles turned in the direction of each guidance plane are paired as well as the nozzles oriented in the opposite direction. Each group of pulse thrusters is connected to the corresponding channel of the control circuit $C_1$ for the bearing pulse thrusters and $C_2$ for the elevation pulse thrusters.

The inputs of the channels $C_1$ and $C_2$ receive the bearing and elevation guidance error signals $E_G$ and $E_S$ which thus represent trajectory deviations detected by the sensor which is locked to the projectile-target location. In a different construction, the channels $C_1$ and $C_2$ can be multiplexed with respect to time to reduce the number of components.

To deliver a thrust, a pair of pulse thrusters must be activated. For this purpose, the squibs of the corresponding propergol blocks are ignited and the propergol blocks thereby fired, the obturating devices of the nozzles turned in the same direction being removed or opened. Then, to cancel this corrective thrust when it is no longer needed, the means closing the diametrically opposite nozzles are removed in succession. As each pair of pulse thrusters is symmetrically arranged with respect to the center of gravity H, the resultant of the thrusts is applied to the center of gravity and does not cause tipping or tilting of the missile. The thrust is a function of the propergol block burning rate and characteristic and the thrust action is determined by the time which elapses between the removal of the obturating devices of the nozzles turned in one direction and the removal of the obturating devices of the nozzles turned in the diametrically opposite direction. As a result, each pair of pulse thrusters applies a burst of thrust initiated as required at a given point in the trajectory and terminated at a later point without terminating the output from the respective nozzles.

Figure 3:
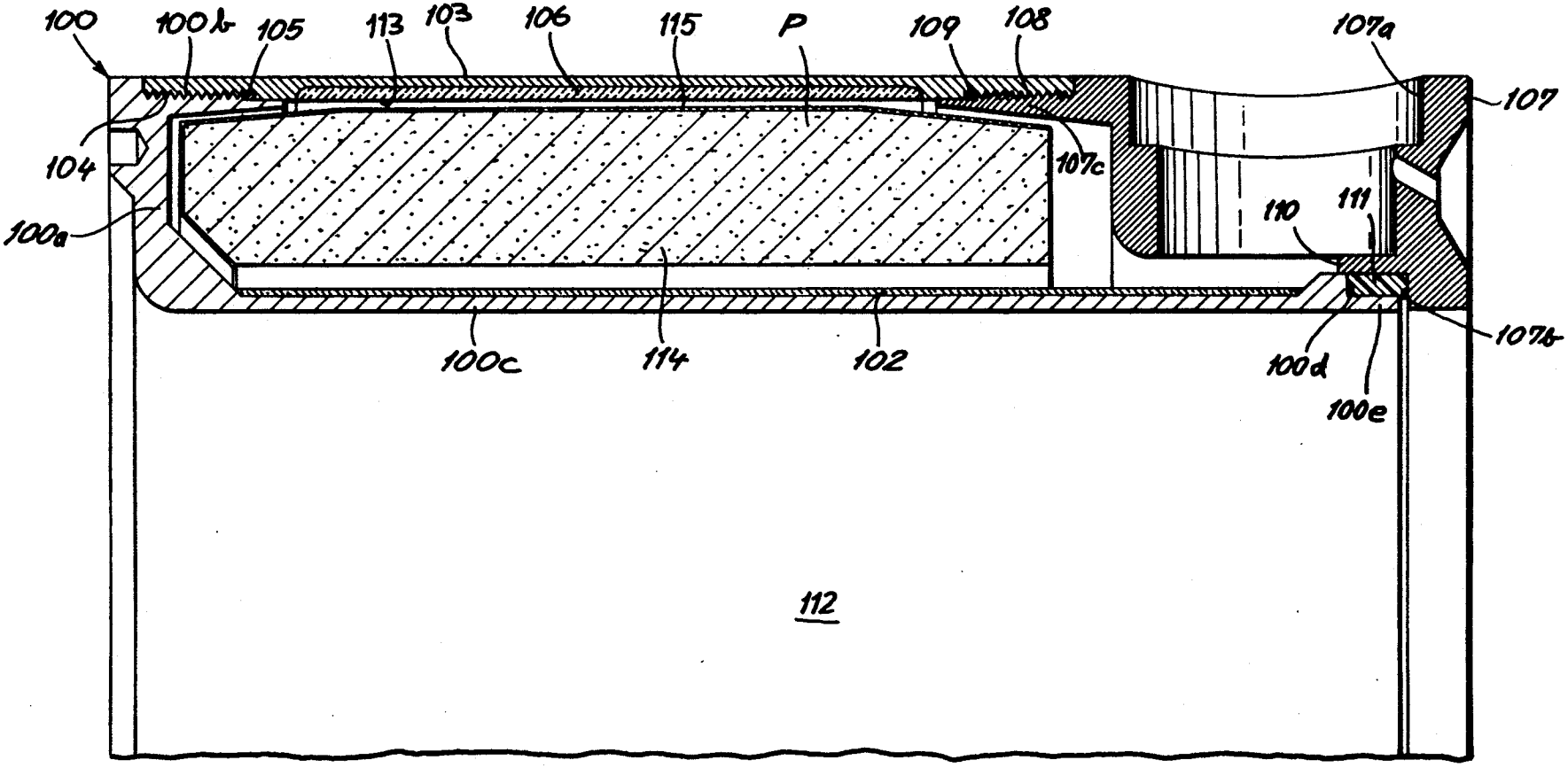
FIG. 3 is an axial cross-sectional view, also somewhat diagrammatic, illustrating in greater detail a pulse thruster according to the invention.

FIG. 3 shows in partial section a pulse thruster in accordance with the invention but without illustrating the nozzle in detail. The nozzle detail has been illustrated in FIGS. 4*a* and 4*b*.

The pulse thruster is generally of toroidal or annular form, i.e. is constituted basically as a ring which surrounds a free space 112 in which other projectile components, e.g. a warhead or control equipment, can be disposed. The external diameter of the pulse thruster corresponds to the projectile caliber or outer diameter so that a multiplicity of units of the type shown in FIG. 3 can be bolted together end to end to form the body of the projectile. The internal diameter is, of course, determined by the radial thickness of the propergol ring and the radial lengths of the nozzles.

Each pulse thruster comprises a circular part 100 which can be composed of a material such as a steel which is provided with a layer of thermal insulation at least on the surface thereof turned towards the propergol body. This thermoprotective layer 102 may be DURISTOS. Structurally, the member 100 may be provided with an annular flange 100*a* which is formed with an external thread 100*b* and a cylindrical portion at one end. The flange 100*a* is formed on a cylindrical tubular member 100*c* terminating in a shoulder 100*d* adapted to receive a gasket 111 as will be described below. The cylindrical threaded portion 100*b* overhangs, at least in part, the tubular portion 100*c*.

The pulse thruster also comprises a circular envelope or jacket 103 having an internal thread 104 which threadedly engages the screw thread 100*b* previously described and which is formed with a further internal screw thread 108. The inner surface of the jacket 103 is formed with a layer of thermal insulation 106 and the seal at the screw thread 104 assured by a circular polytetrafluoroethylene gasket 105.

A nozzle ring 107 is provided at the opposite end of the pulse thruster and is formed with the nozzle bores one of which is represented at 107*a*. The actual nozzle construction can be of the type shown in FIGS. 4*a* and 4*b*.

The ring 107 has a shoulder 107*b* which bears against the sealing gasket 111, the latter being trapped between cylindrical portions 110 of the ring 107 and a cylindrical projection 100*e* of the cylindrical tubular part 100*c*. The ring 107 also is formed with an overhanging portion 107*c* connected via the screw thread 108 to the jacket 103, a polytetrafluoroethylene gasket 109 being provided between these parts adjacent the screw thread to ensure sealing.

The jacket and the tubular portion 100*c* which are coaxial with one another and the flange 100*a* and ring 107 together define a chamber 113 which receives the solid propergol block 114 whose surfaces can be partly covered by an inhibitor material 115 such as that marketed under the name RHODESTA. The localized combustion of the powder block on its inner surface and one end face enables a thrust to be produced which remains generally constant as a function of time.

The propergol used in accordance with the present invention may be a "doped EPICTETE", for example. With a pulse thruster of a caliber of 130 mm, a length of about 100 mm, a propergol mass of 450 g, it is possible to obtain a combustion pressure of about 100 bars and a mean thrust of 610N for 1.5 seconds.

Figure 4A:
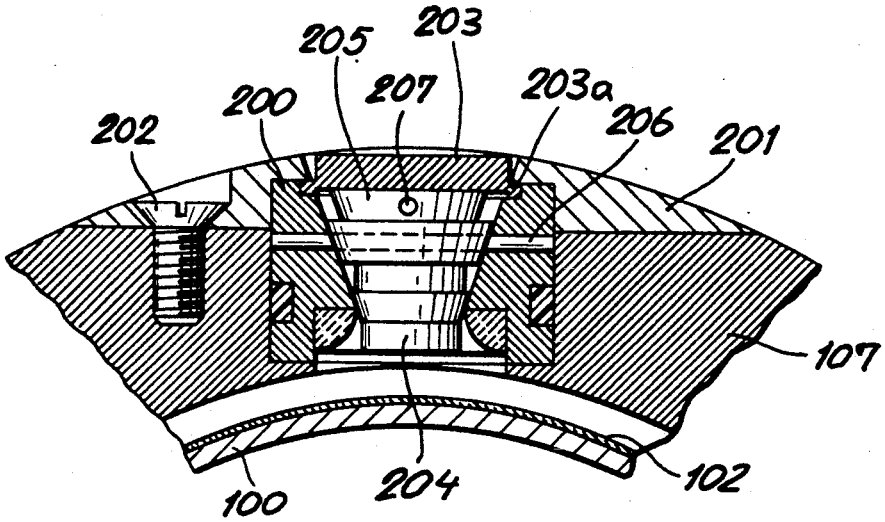
FIG. 4*a* is a cross-sectional view taken transverse to the view of FIG. 3 and illustrating in a substantially larger scale that that of FIG. 1 the means for blocking the pulse-thruster nozzle prior to the triggered opening thereof.
Figure 4B:
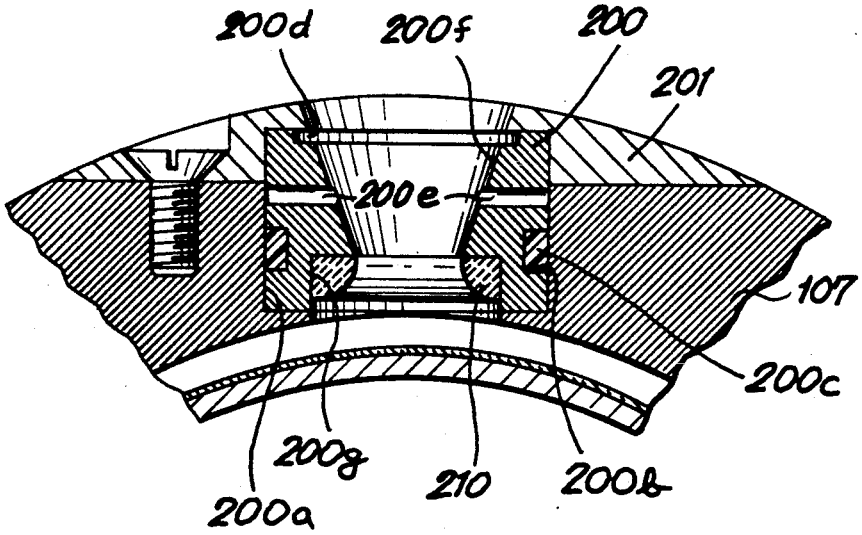
FIG. 4*b* is a view of the nozzle of FIG. 4*a* upon opening of the latter.

FIG. 4*a* and FIG. 4*b* show details of the construction of the thruster nozzles and particularly the obturating means therefor. The nozzles are disposed in the thickest portion of the ring 107 which has been described in FIG. 3. FIG. 4*a* shows the nozzle in cross section with the closing member in place while FIG. 4*b* shows the device upon removal of the closing member.

The nozzle is a Laval-type (converging-diverging) thrust formed in a cylindrical bushing 200 which is fitted into a bore 200*a* (corresponding to the bore 107*a*) in the ring 107. The bushing 200 is provided with an outwardly open circumferential groove 200*b* in which is received a sealing ring 200*c*.

The bushing 200 is held in place by a plate 201 which is fixed to the ring 107 by screws 202 of which only one has been illustrated. The passage-closing device is formed by a cover 203 which is stepped so as to be held in place by the plate 201 against a seat 200*d* formed in the outer end of the bushing 200 and in the form of a recess.

The cover rests against a conical member 204 whose upper part forms a cup in which a pyrotechnical charge 205 is disposed. The cover 203 is made of a material such as annealed copper and is held captive by the plate 201 against the bushing 200.

Since the cover 203 is formed with an outwardly projecting rim 203*a* at its edge engaged in the seat 200*d* and this rim is fixed to the body of the cover by an extremely small thickness of material, the cover 203 can be readily sheared upon explosion or ignition of the charge 205. It is the special shape of the cover in the region in which it is held which makes it easy to shear in the manner described.

The conical cup 204 is held in place by a pin 206 which extends transversely to the axis of the cup and extends into diametrically opposite bores 200*e* formed in the bushing 200.

The charge 205 in the cup 204 is fired by a squib 207 which is inserted into the charge and is electrically activated in the manner previously described. This construction of the passage-closing device has been found to be highly effective in satisfying the requirements of the pulse thruster of the present invention.

The activation signal ignites the propergol block P. Then the squib 207 is fired to ignite the powder charge 205 ejecting the cover 203. 123 msec later, the pressure of the gases produced by combustion of the propergol is sufficient to shear pin 206 and drive the conical plug or cup 204 out of the nozzle passage 200*f* which, in the manner of these plugs, diverges outwardly to facilitate dislodgement of this plug or cup.

As FIG. 4*b* shows, the nozzle after ejection of the plug is completely free with the passage 200*f* communicating with the burning chamber. The inlet end of the nozzle is provided in the form of a ring 210 of refractory metal. This ring can be set into an axially and inwardly open recess 200*g* formed in the bushing 200.

Naturally, using the principles which have been described and which constitute the best mode currently known to me for carrying out the invention in practice, it is possible to deviate somewhat in structural details. For example, propergol may be a solid cylindrical block rather than a tubular element and the pulse-thruster housing may also be a cylindrical element rather than a toroidal body if it is not necessary to provide a central passage or hole.

In another variant, the ring 107 may be provided with two pairs of nozzles oriented along the two guidance director planes and the gas-generator chambers may be subdivided to provide gas generators connected to each of these two pairs of nozzles. In still another variant on the same theme, the pulse thruster may have more than two pairs of nozzles and the pairs may be operated as required to provide any desired thrust direction.

Figure 5:
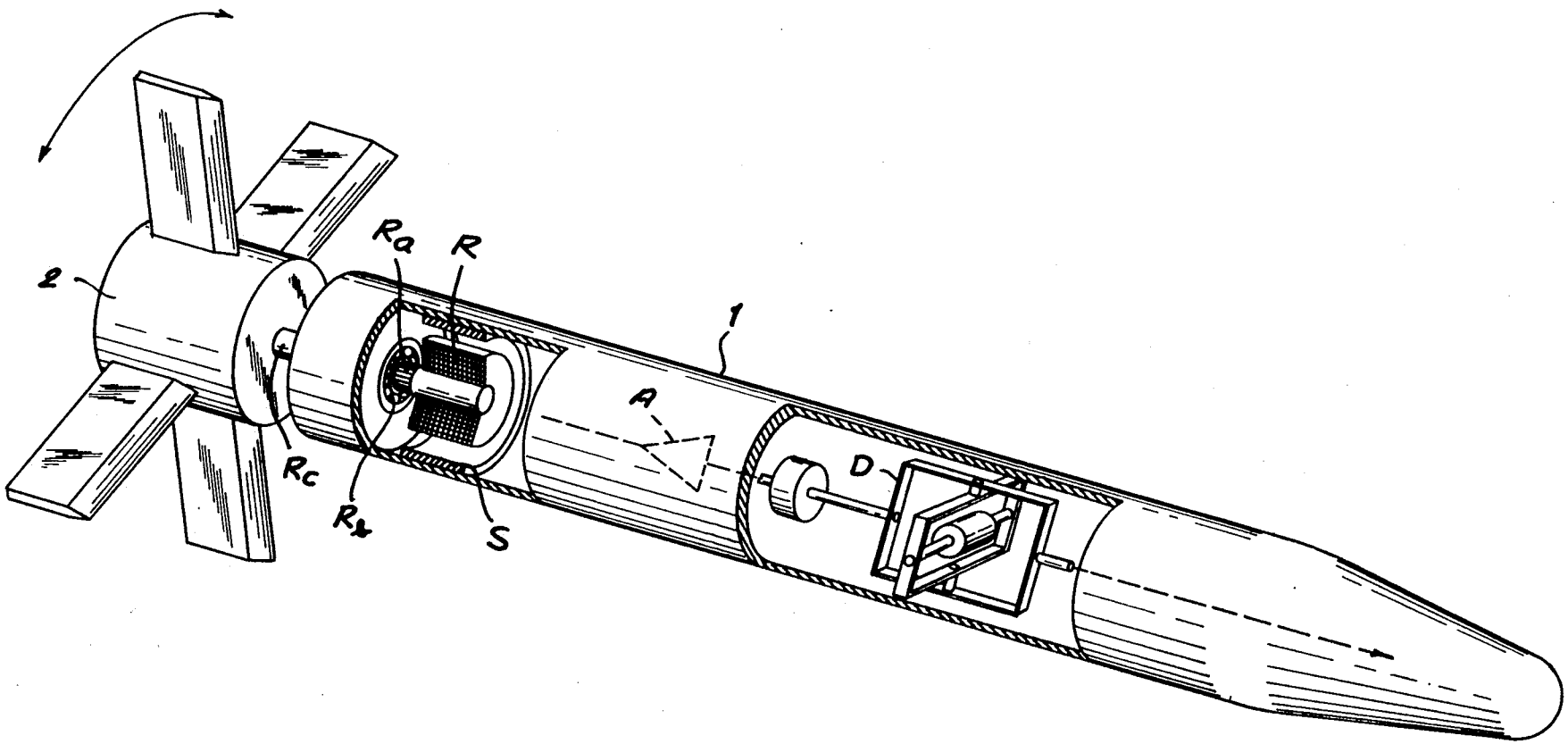
FIG. 5 is a view similar to FIG. 1, also highly diagrammatic in form, illustrating the means for stabilizing the attitude of the projectile against rolling.

The roll-stabilizing means has been illustrated in somewhat greater detail in FIG. 5 although also in diagrammatic form. More specifically, the body 1 of the projectile has the aforementioned empennage 2 rotatably mounted at the rear of the body and provided with radially extending fins which are fixed on the empennage. The empennage and the fins are thus able to rotate freely about the longitudinal axis of the projectile. The fin-setting angle with respect to the longitudinal axis or, more specifically, to a common axial plane through the fin and the body, is preferably zero.

At the rear of the projectile body, a force-couple transducer is provided, e.g. in the form of a couple motor operating on direct current with a direct pickup. The stator S of this transducer is formed by a magnet and is fixed in the projectile body. The wound rotor R with a segmented commutator $R_a$ is fixed to the rotating shaft $R_c$ of the empennage 2, the shaft $R_c$ being rotatagle in the bearing $R_b$ of the body.

Within the projectile body 1, an attitude detector D is disposed. This detector has been shown only in the most diagrammatic fashion in FIG. 5 and can include a gyroscope whose drift is very low by comparison with the activation time of the pulse thrusters during a projectile trajectory correction phase. An error signal amplifier A, containing the corrector circuit networks, enables the required transfer function to be obtained in the servocontrol loop from the gyroscope attitude detector and the empennage drive R, S. In other words this error amplifier provides the link between the roll-attitude detector and the couple transmitter.

The device illustrated in FIG. 5 operates as follows.

The empennage 2 is free to rotate in either sense. Because of the high longitudinal (forward) speed of the projectile, the aerodynamic reaction on the radial fins of the empennage opposes rotation of the fins, establishing a zero point for the couple transmitter R, S. Any projectile body roll is then detected by the atitude detector D which delivers a roll-error signal and corrects the roll attitude of the body.

Figure 6:
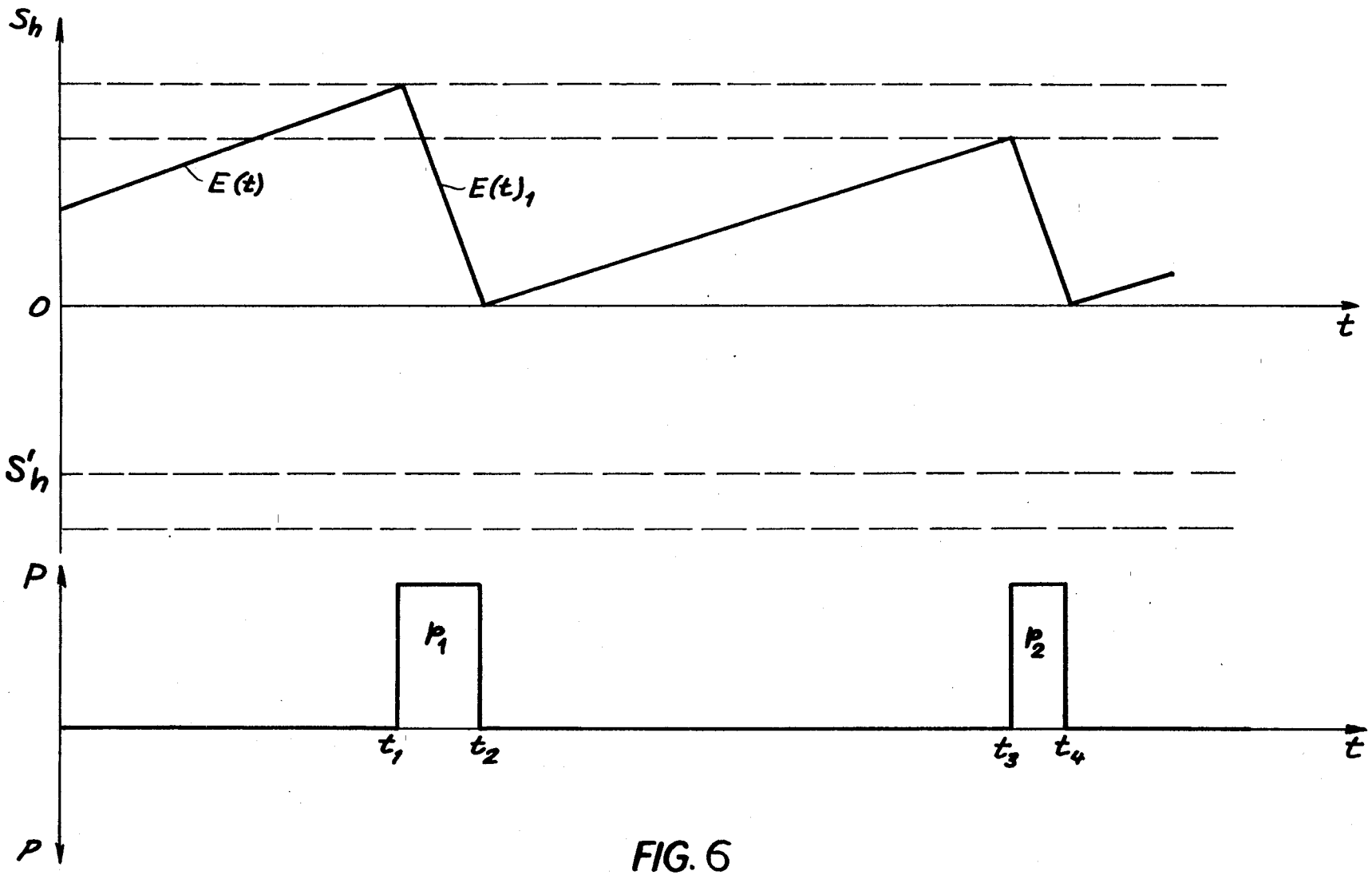
FIG. 6 is a pulse diagram illustrating the phases of the pulse-thruster operation.

FIG. 6 is a diagram of trajectory deviations $S_h$ or $S'_h$, plotted along the ordinate, against time t plotted along the abscissa. The corresponding plot of the thrust peaks p supplied by the pulse thrusters along the ordinate against time along the abscissa is likewise shown.

The trajectory deviations E(t), i.e. the deviations E as a function of time, detected by the trajectory guidance error sensor, are compared in amplitude and sign with a given reference level $S_h$ and its image value $S'_h$. Equality of the signal E(t) with the reference level activates at time $t_1$ the first pair of pulse thrusters which produce a corresponding transverse thrust p as represented at $p_1$. Under the effect of this thrust, the error signal tends towards zero (ramp $E(t)_1$) and at the instant $t_2$, this restoration deviation is detected and the first pair of pulse thrusters is disabled by energization of the diametrically opposite nozzles.

Subsequently, when the trajectory deviation again increases to the threshold value under the effect of interfering factors or movement of the target, a second pair of pulse thrusters is enabled or activated at the instant $t_3$. The result is a second pulsed thrust $p_2$ for the duration $t_4$–$t_3$, this second pulse terminating at the time $t_4$ corresponding to the dropping flank of the function E(t).

It is not necessary that the threshold be the same as the previous threshold for triggering of the second pair of pulse thrusters. Different values of the threshold may be programmed into the pulse thruster control circuit.

Naturally, the countervailing deviation of the position of the center of gravity of the rocket which causes the desired flight path to be maintained, need not reduce the error signal to zero to cause deactivation at the time $t_2$ or $t_4$.

Figure 7:
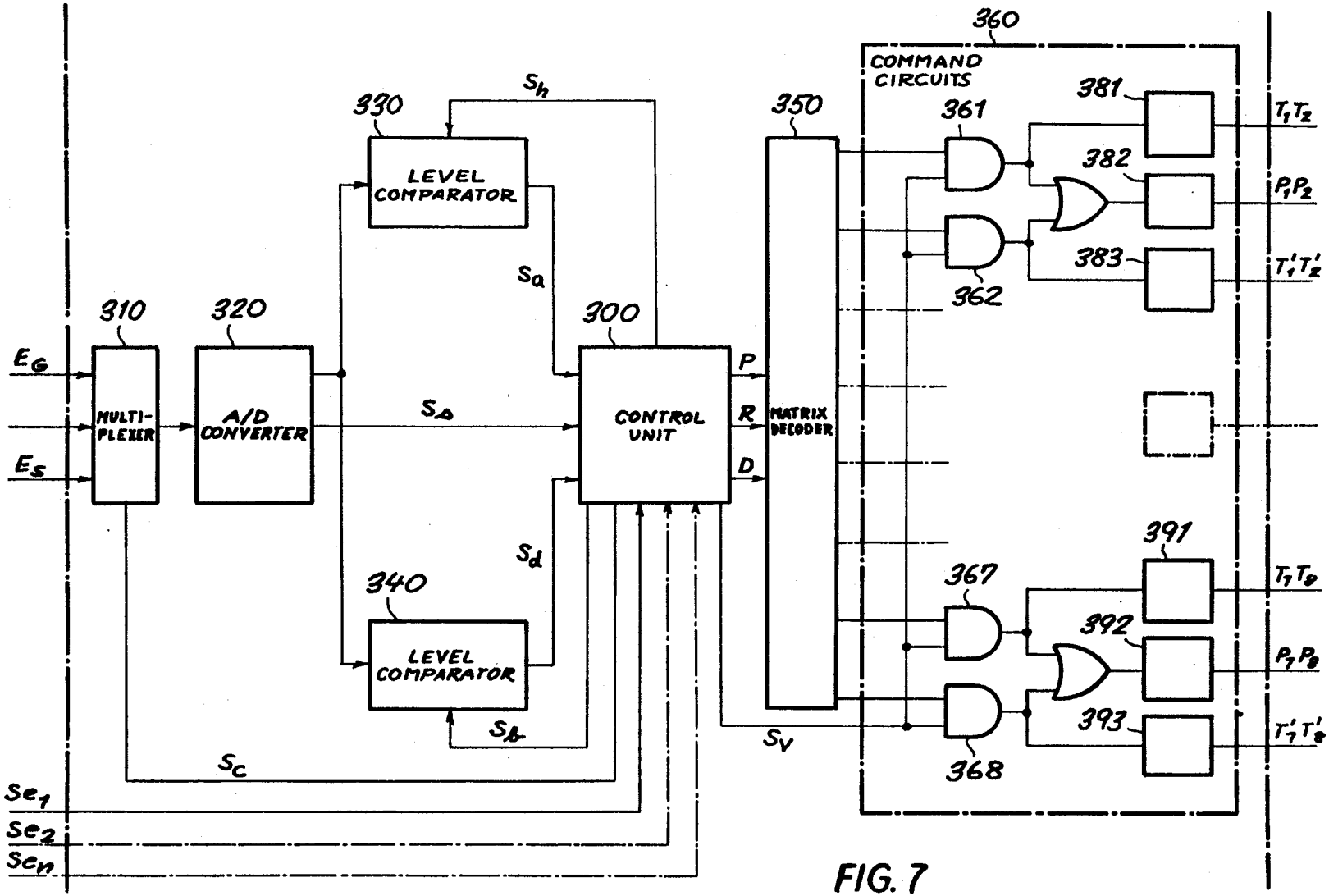
FIG. 7 is a block diagram of the pulse-control circuit of the present invention.

In FIG. 7 I have shown, in block-diagram form, the elements of the pulse-thruster controlled circuitry for a projectile having two orthogonal director planes, each of the director planes having two pairs of pulse thrusters. Naturally, larger numbers of pairs of pulse thrusters can also be provided without deviating from the principles of the circuitry shown in FIG. 7. All of the circuits are of the digital type.

The input supply to the control circuitry of FIG. 7 consists of the signals $E_G$ and $E_S$ which, as previously mentioned, represent trajectory deviations in each of the two director planes. The control circuit delivers output signal $T_1$ $T_2$, $P_1$ $P_2$, $T'_1$ $T'_2$, $T_7$ $T_8$, $P_7$ $P_8$ and $T'_7T'_8$ enabling the indicated pairs of pulse thrusters to be activated and deactivated in sequence. Naturally, deactivation of a pulse thruster in the present invention is accomplished by triggering the nozzle closures diametrically opposite the previously effective pair of nozzles.

The circuit can comprise, according to the preferred mode of carrying out the invention in practice, a control logic circuit 300 or central processor whose task is to control all of the remaining circuitry. The inputs $E_G$ and $E_S$ are applied to an input multiplexer which is triggered by a multiplexing clock of the central processing unit 300, e.g. via the line $S_C$ to commutate the error homing signals $E_G$ and $E_S$ alternately to an analog/digital converter 320. The repetition period of the clock pulses delivered by line $S_c$ is less than the response of the guidance system.

The analog/digital converter 320 converts the multiplexed analog signals $E_G$ and $E_S$ to digital form and produces the deviation sign $S_s$.

A level comparator 330 receives both the output signals from the converter 320 and a reference level $S_h$ whose amplitude is programmed and can be supplied by the logic circuitry of the central processor 300. The amplitude of the reference signal $S_h$ can be either fixed or modified during the pulse-thruster activation sequence and represents the normal deviation which causes activation of a pair of pulse thrusters.

A second level comparator 340 receives the output signals from the converter 320 and a reference level $S_b$ whose amplitude is also programmed and which is supplied by the control logic circuitry of the central processor 300. The amplitude $S_b$ can either be fixed or modified during the pulse-thruster deactivation sequence. The value $S_b$ represents the threshold at which the falling flank of the deviation or error signal E(t) will deactivate the pulse thrusters. The latter threshold may be zero.

The output signal $S_s$ corresponding to the homing error signal sign, and the comparator output signals $S_a$ and $S_d$ are supplied to the central processor 300 which also receives the state signals $Se_1$, $Se_2$ . . . $Se_m$ representing the state of the sensor at successive time periods after launch. This correction of signals enables central unit 300 to prepare coded signals P, R and D respectively representing the director plane involved, the pair of pulse thrusters in this director plane which is to be activated, and the direction of the gas jet that the pulse thruster is to supply. A validation signal $S_v$ which enables the signals P, R, D, is also provided by the central processor 300.

Below there is given the truth table for the signals P, R and D, i.e. the binary code of these signals corresponding to the pairs of pulse thrusters $I_1$, $I_2$, $I_7$, $I_8$, the propergol bodies or loaves, and nozzles.

| | | P | R | D | |
|---|---|---|---|---|---|
| $I_1$ $I_2$ | $T_1$ $T_2$ | 0 | 0 | 0 | $P_1$ $P_2$ |
| | $T'_1$ $T'_2$ | 0 | 0 | 1 | |
| $I_5$ $I_6$ | $T_5$ $T_6$ | 0 | 1 | 0 | $P_5$ $P_6$ |
| | $T'_5$ $T'_6$ | 0 | 1 | 1 | |
| $I_3$ $I_4$ | $T_3$ $T_4$ | 1 | 0 | 0 | $P_3$ $P_4$ |
| | $T'_3$ $T'_4$ | 1 | 0 | 1 | |
| $I_7$ $I_8$ | $T_7$ $T_8$ | 1 | 1 | 0 | $P_7$ $P_8$ |

The signals P, R and D are decoded in a decoding matrix 350 which delivers eight address signals to the pulse-thruster control unit 360. The logic circuitry of this control unit includes eight AND logic gates 361–367 . . . receiving the address signals as well as the validation or enabling signals $S_v$.

The output signals of two adjacent gates are supplied to OR gates 371–374 whose output signal causes the respective propergol blocks $P_1$, $P_2$ . . . $P_7$, $P_8$ to be fired.

At the same time, the AND gates produce output signals which open the nozzles $T_1$, $T_2$, $T_7$, $T_8$.

The low-level output signals of the logic gates are amplified in 12 power amplifiers 381–392. The lead and delay elements enabling the signals to be phase-corrected or enabling corrections to be introduced into the guidance loop transfer function have not been shown and are well known in the art.

The guided projectile of the invention can have a warhead effective against heavily protected targets and may be fitted with a booster propellant or section which may be dropped before trajectory-correction instructions are applied so that the center of gravity of the projectile is actually located in the center of the pulse-thruster group activated at any given instant.

The structural details of a guided missile in accordance with the best mode embodiment of the invention has been illustrated in FIGS. 8*a*–8*d*. This missile is provided with a warhead as well as with a releasable booster unit.

The projectile shown in FIGS. 8*a*–8*d* comprises basically two parts of which part A (FIGS. 8*a*–8*c*) forms the offensive projectile unit and part B (FIGS. 8*c* and 8*d*) forms the propulsion unit which is dropped during flight. As an example, the trajectory corrections and hence the transverse thrusts corresponding thereto are applied along two orthogonal main guidance planes which, as in the manner set forth above, are arbitrarily termed bearing and elevation planes.

The structural elements of FIGS. 8*a*–8*d* which correspond to elements already described have been given the same reference numerals.

Thus, for example, the offensive portion of the missile (part A which contains inter alia the warhead) comprises a front section or nose cone 10 containing the electro-optical homing device 10', the processing circuits 12 for responding to the sensor 10' and locking the latter onto the target, this circuit means providing output signals representing the guidance-error or trajectory-deviation signals in the two guidance director planes.

The control circuit 13 produces the correction instructions in the manner previously described with particular reference to FIG. 7. The nose cone of the projectile is transparent to electromagnetic waves and the sensor 10' and the processing circuits 12 form a homing head operating in the passive infrared or semi-active laser mode.

Directly rearwardly of the nose cone 10, the leading end of the body of the projectile is formed with a hollow warhead 21 and its explosive primer 22. Rearwardly of the warhead 21, the section 30 of the rocket is provided with four pairs of toroidal-shaped pulse thrusters (annular in configuration) as has been described in connection with FIG. 3, two pairs of pulse thrusters for each of the guidance director planes. Thus the pairs of pulse thrusters $I_1$, $I_2$ and $I_5$, $I_6$ are provided for the bearing plane while the pairs of thrusters $I_3$, $I_4$ and $I_7$, $I_8$ are provided for the elevation plane. The pairs of pulse-thruster nozzles for the bearing plane are offset by 90° angularly about the axis of the system relative to the orientations of the nozzles for the elevation guidance plane.

The center of the pulse thrusters is formed with a chamber or passage in which is received a semi-perforating armor-piercing nose 31, its associated pyrotechnical charge 32 and a delayed detonator 33.

Rearwardly of the pulse thruster section, is a section 40 which contains the primary electrical energy source which may be, for example, a gas turbine fired by ignition of a propellant, with an electrical generator such as an alternator. A triggerable primary electrochemical battery may also be used as a primary energy source.

In the embodiment shown, the turbine is illustrated diagrammatically at 40*a* and the generator at 40*b*.

Figure 8A:
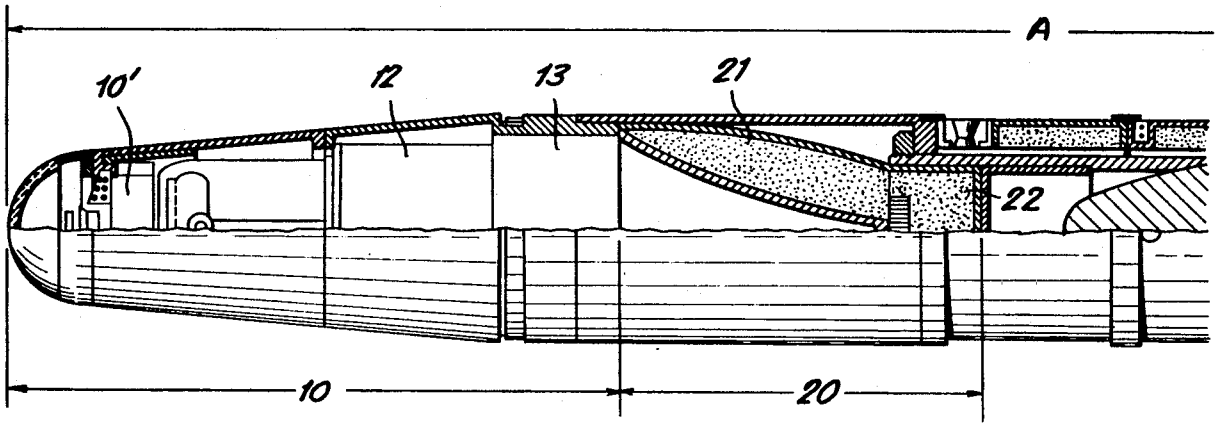
FIG. 8*a* shows the nose portion of a missile according to the present invention partially in axial section.
Figure 8B:
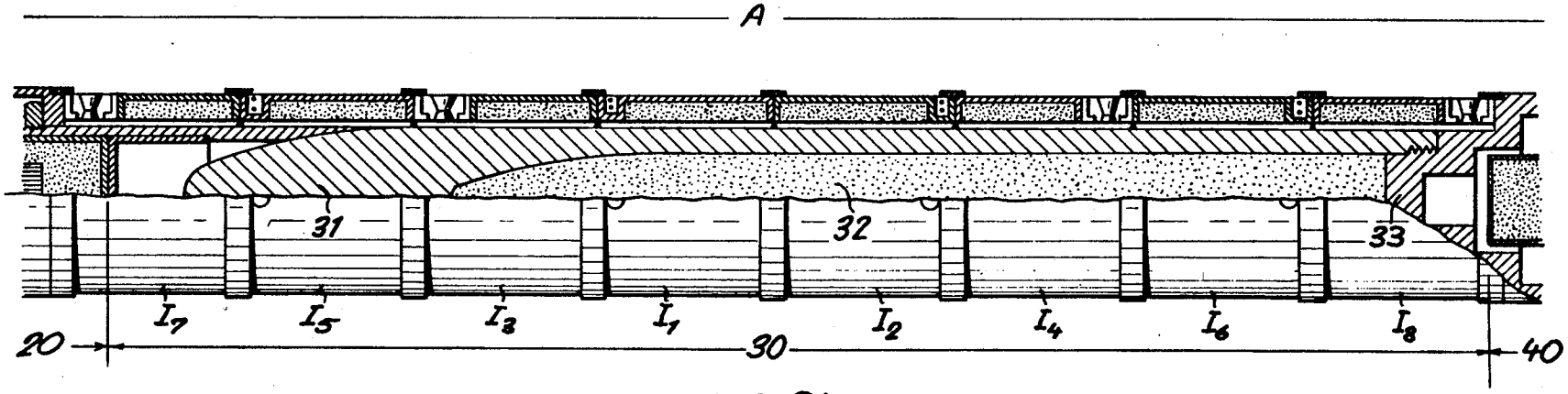
FIG. 8*b* shows a section of the projectile in a view similar to FIG. 8*a*, directly adjacent the nose portion.
Figure 8C:
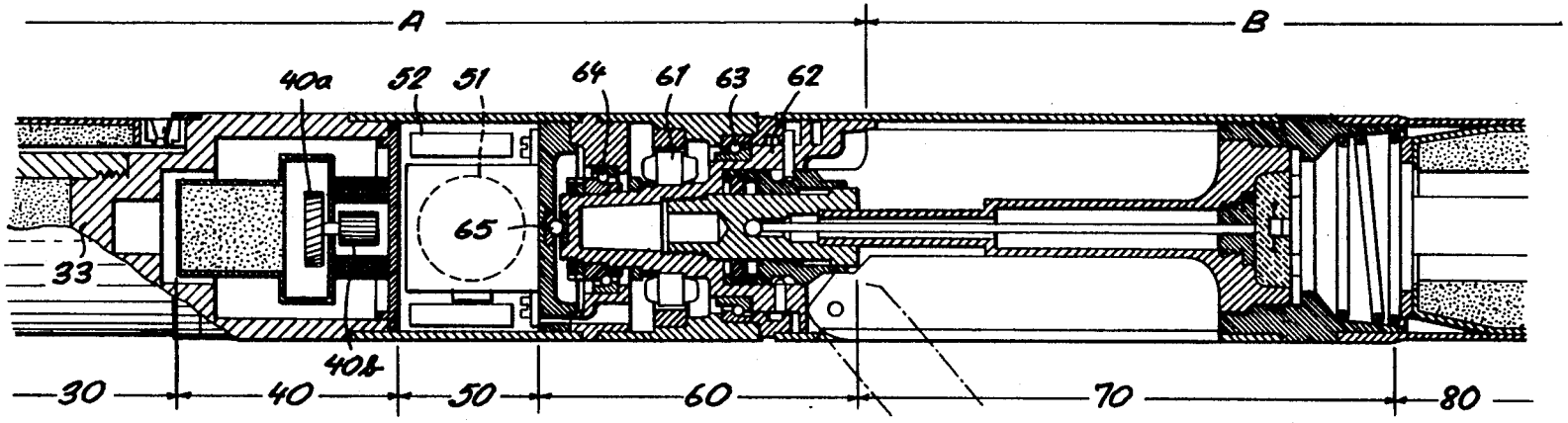
FIG. 8*c* shows the details of the roll-stabilizing mechanism in an axial section through the missile illustrating the region immediately rearwardly of the section shown in FIG. 8*b*.
Figure 8D:
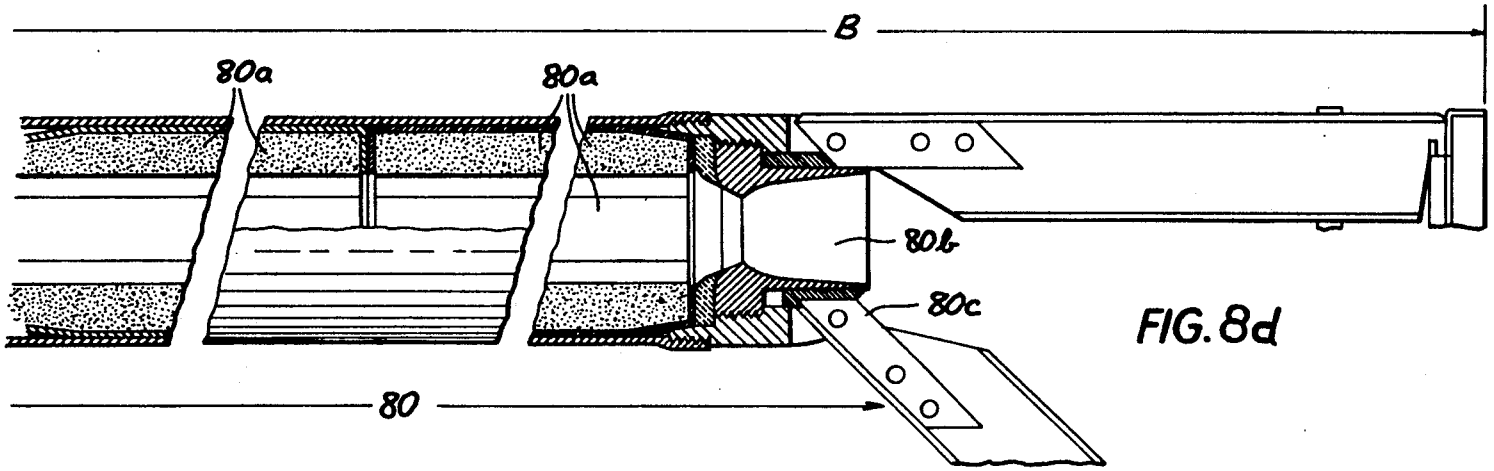
FIG. 8*d* is is an axial cross-sectional view illustrating the rear end of the same missile.

As can be seen from FIG. 8*c*, the section of the body immediately rearwardly of the primary energy source 40 is constituted as a housing receiving the servocontrol means for stabilizing the projectile roll attitude. In this section, the attitude detector 51, formed by a gyroscopic device as previously described with almost instantaneous starting and fitted with caging and uncaging means, also includes the amplifiers 52 for amplifying the error signal. The connection of this system to the couple transmitter has already been described.

The rearmost section of part A of the projectile is shown at 60 and contains the couple transmitter 61 and the thinned empennage 62 whose free rotation is ensured by bearings having the ball races 63, 64 and 65. The fins spring out upon release of the second section B of the projectile. The attack portion of the projectile A thus operates in the manner described in connection with FIGS. 1, 5 etc.

The booster part B of the projectile comprises a section 70 receiving the explosive and mechanical devices enabling the booster rocket motor to be dropped in flight and a set of blades or fins which open when the motor is dropped to enable the booster motor to fall to the ground safely. The next section 80 constitutes the propellant section and makes use of a conventional solid propellant such as propergol as has been described previously. The body of solid propellant has been represented at 80*a*, the gases released by this solid propellant being ejected through the rocket nozzle 80*b*. The rocket nozzle 80*b* is surrounded by an array of fins 80*c* which swing outwardly upon launching and are angularly equispaced about the rocket nozzle 80*b*. The rocket shown in FIGS. 8*a*–8*d* and described with reference to these FIGURES has been found to be highly advantageous since, apart from the advantages already mentioned, it eliminates all aerodynamic surfaces or rudders for initial firing. The rocket can be fired from a launching tube by a cannon effect, whereupon the booster rocket is fired, section B is discharged and released, and section A can home in on the target with lateral thrust control of the flight path in the manner previously described. All moving parts are eliminated for control of the pulse thrusters and hence the projectile can be structurally robust. The guidance system is of modular design and can be applied to different types of guided projectiles, shells, missiles, bombs and the like.

Naturally, the invention is not limited to the specific construction described, even though the best mode has been illustrated and described in connection with FIGS. 8*a*–8*d* as to the particular configurations of the elements, in FIGS. 4*a* and 4*b* as to the obturating means, in FIG. 5 with respect to the inertial roll attitude control, etc. Many variants may be used within the spirit and scope of the claims and thus the number of pairs of pulse thrusters in each guidance director plane may be different from the number in the other plane and may be more or less than the number which has been used for purposes of illustration here. The guidance means may be used to modify the trajectory of the projectile which can be fired vertically and then inclined to the horizontal by use of the pulse thrusters and thereafter controlled as to the homing path thereby. The guidance means may be activated by remote control, the onboard error guidance measurement sensor being replaced by a distance-sighting unit which prepares the trajectory-correction instructions and transmits them to the projectile.

I claim:

1. A guided projectile comprising:

an elongated axially extending projectile body having a front end, a rear end and a center of gravity located along the axis of said body between said ends;

a plurality of pulse thrusters axially spaced along said body and each provided with a pair of diametrically opposite, oppositely opening thrust nozzles lying in a guidance director plane, the nozzles of both said pulse thrusters being disposed symmetrically on opposite sides of said center of gravity in the same guidance director plane;

respective triggerable-release closures for each of said nozzles; and control means for simultaneously triggering both of said pulse thrusters and for releasing said closures of the nozzles oriented in the same direction on opposite sides of said center of gravity to apply a resultant thrust to said center of gravity in response to an error signal representing deviation from a desired trajectory, thereby returning the projectile to said trajectory, said control means releasing the closures of the diametrically opposite nozzles to terminate the resultant thrust at said center of gravity upon restoration of the desired trajectory.

2. The projectile defined in claim 1 wherein each of said pulse thrusters includes a chamber communicating with the respective thrust nozzles and receiving a body of an electrically triggerable gas-producing material, the triggerable-release closures for said nozzles being electrically energizable, the bodies and triggerable-release closures of the two pulse thrusters simultaneously operable to produce thrust in the same direction on opposite sides of said center of gravity being electrically interconnected.

3. The projectile defined in claim 1 wherein said guidance director plane contains n pairs of pulse thrusters energizable in sequence at different points along said trajectory when the trajectory deviations are at least equal to predetermined deviations and are deactivated by energization of opposite nozzles when trajectory deviations are reduced to predetermined low values.

4. The projectile defined in claim 1 wherein said nozzles are provided in two guidance director planes orthogonal to one another, the nozzles along one of the director planes alternating axially outwardly from said center of gravity with the nozzles of the other director plane.

5. The projectile defined in claim 1 wherein the pulse thruster along said director plane and an adjacent pulse thruster along another director plane are interconnected mechanically and the two pairs of nozzles are arranged in a single ring, each of said pairs of nozzles being coupled to a respective gas generator of the respective pulse thruster.

6. The projectile defined in claim 1 wherein said control means includes level compensators with preprogrammed thresholds for operation of said triggerable-release closures and said pulse thrusters.

7. The projectile defined in claim 1 wherein said control means includes a control logic unit delivering instructions dependent upon the respective guidance director plane to a respective pair of pulse thrusters for controlling the direction of thrust, means for addressing the devices priming gas generators of the pulse thrusters, and means for activating the respective triggerable-release closures.

8. The projectile defined in claim 1, further comprising a deviation-measurement sensor on said body in the form of a homing device for producing said error signal.

9. The projectile defined in claim 1 wherein said error signal is transmitted to said projectile from a sighting apparatus outside said projectile and capable of measuring trajectory deviations thereof.

10. The projectile defined in claim 1 wherein said pulse thrusters are of toroidal configuration and have annular chambers receiving a triggerable body of a solid propellant capable of producing gases ejectable from said nozzles, the pulse thrusters surrounding an insulated free space and having respective nozzles formed in a ring at the end of the respective annular chamber.

11. The projectile defined in claim 10 wherein said pulse thrusters surround a portion of a warhead for said projectile.

12. The projectile defined in claim 1, further comprising means for roll stabilization on said body and including a thinned empennage at the rear of said body capable of freely rotating about said axis, a couple transmitter connecting the empennage and the body, an amplifier connected to said couple transmitter, and a roll-attitude detector inside said body connected to said amplifier.

13. The projectile defined in claim 12 wherein said empennage is adapted to receive a releasable rocket motor which can be disengaged from said body and is provided with a winged-fin system.

14. The projectile defined in claim 1 wherein the triggerable-release closures for each of said nozzles comprise two mechanical elements connected in series, a first of said elements blocking the mouth of the respective nozzle and the second of said elements blocking a passage of the nozzle, means for dislodging the first element by pyrotechnics, the second element being driven out of said passage by burning gases from the respective pulse thruster, each of said pulse thrusters including a chamber and a body of solid propellant ignitable to produce said gases.

15. The projectile defined in claim 14 wherein the first element is a cover frangible at its periphery and adapted to be dislodged by a triggerable explosive charge.

16. The projectile defined in claim 14 wherein the second element is a truncated conical member received in said passage and retained therein by a shear element, said truncated conical member being hollowed out to hold a pyrotechnic charge for the first element.

* * * * *